United States Patent [19]

Senese

[11] 4,095,672

[45] Jun. 20, 1978

[54] APPARATUS FOR REMOVAL OF LUBRICATING COMPOSITION AND METHODS FOR USING SAME

[75] Inventor: Frank J. Senese, Hickory Hills, Ill.

[73] Assignee: Atlantic Richfield Company, Philadelphia, Pa.

[21] Appl. No.: 674,358

[22] Filed: Apr. 7, 1976

[51] Int. Cl.[2] ..... F01M 11/04

[52] U.S. Cl. ..... 184/1.5; 116/70; 116/137 R; 417/183

[58] Field of Search ..... 184/1.5, 1 R; 116/67 R, 116/70, 138, 137 R, 140; 417/183

[56] References Cited

U.S. PATENT DOCUMENTS

| | | | |
|---|---|---|---|
| 511,079 | 12/1893 | Hooker | 417/183 |
| 1,748,004 | 2/1930 | Urquhart | 417/183 X |
| 1,854,098 | 4/1932 | Black | 417/183 |
| 1,986,476 | 1/1935 | Ironside | 184/1.5 UX |
| 2,321,483 | 6/1943 | Haedike | 417/183 X |
| 2,552,749 | 5/1951 | Tabet | 184/1.5 |
| 2,603,312 | 7/1952 | Tabet | 184/1.5 |
| 2,612,289 | 9/1952 | Koester | 184/1.5 X |
| 2,946,293 | 7/1960 | Henshaw | 417/183 |
| 3,033,311 | 5/1962 | Edgar et al. | 184/1.5 |
| 3,095,062 | 6/1963 | Neely | 184/1.5 |

*Primary Examiner*—David H. Brown

*Attorney, Agent, or Firm*—John B. Goodman; Frank J. Uxa

[57] ABSTRACT

An improved apparatus for removing lubricating compositions from crankcase oil pans of internal combustion engines through the oil dipstick well of the engine involves signalling means, acting in response to the amount of vapor flowing to the vacuum chamber of the apparatus to signal, preferably audibly signal, the completion of removal of lubricating composition from the crankcase oil pan.

An improved method for removing lubricating composition from crankcase oil pans is also disclosed.

9 Claims, 4 Drawing Figures

APPARATUS FOR REMOVAL OF LUBRICATING COMPOSITION AND METHODS FOR USING SAME

This invention relates to an improved apparatus and method for removing lubricating compositions from crankcases of internal combustion engines. More particularly, the invention relates to an improved apparatus and method for using same to remove lubricating compositions from internal combustion engine crankcases through the oil dipstick well.

The crankcases and associated components of internal combustion engines are lubricated by compositions, e.g., lubricating oils, which periodically should be removed and replaced to achieve optimum lubrication and engine performance. Such engines are normally equipped with an oil dipstick well into which may be placed a removable oil dipstick. The dipstick, when in place in the well, extends into the reservoir, i.e., crankcase oil pan, holding an amount of the lubricating composition. The dipstick can be removed from the well with lubricating composition clinging to it up to the level of the composition in the oil pan. By calibrating the dipstick, the amount of lubricating composition in the oil pan can be ascertained.

In order to remove the lubricating composition from the oil pan, it has customarily been necessary to pull a drain plug at, or near, the bottom of the oil pan. This is a somewhat tedious, time-consuming and dirty job. Therefore, it would be advantageous to provide other means for removing these lubricating compositions.

U.S. Pat. Nos. 2,612,289 and 3,095,062 proposed systems for removing lubricating compositions from the crankcase oil pans of internal combustion engines through the oil dipstick well. In such a scheme, the oil dipstick is removed and a hollow probe is inserted into the dipstick well and the lubricating composition is sucked from the crankcase sump through the probe.

Among the problems encountered using such oil changers is that of determining when the removal of lubricating composition is complete. A positive and sensitive indication that the removal of the composition is complete would tend to maximize the time-saving feature of systems using the dipstick well for such removal. Also, since such oil changers are particularly applicable to use by individual owners of motor vehicles, e.g., automobiles, trucks and the like, who may be mechanically unskilled, a positive indication of removal completion would be particularly valuable. In view of the above, it is desirable to provide an improved apparatus for removing lubricating compositions from the crankcases of internal combustion engines.

Therefore, it is an object of the present invention to provide an improved apparatus for removing lubricating compositions from crankcases of internal combustion engines.

Another object of the present invention is to provide an improved method for removing lubricating compositions from crankcases of internal combustion engines. Other objects and advantages of the present invention will become apparent hereinafter.

An improved apparatus for removing lubricating composition from the crankcase oil pan of an internal combustion engine through the oil dipstick well of the engine has now been discovered. The apparatus comprises a hollow probe means, having first and second ends, through which the lubricating composition from the crankcase oil pan passes, the first end of the probe being capable of reaching the proximity of the bottom inside surface of the oil pan through the oil dipstick well; a conduit, having first and second ends, through which the lubricating composition passes from the probe means; a vacuum chamber, attached to and in fluid communication with the conduit, capable of holding sufficient vacuum so as to cause lubricating composition to pass from the conduit, and ultimately from the crankcase oil pan, into the vacuum chamber and to be collected therein; a vacuum source in fluid communication with the vacuum chamber capable of providing the vacuum chamber with the desired level of vacuum; and a signalling means acting in response to the amount of vapor flowing to the chamber to signal, preferably audibly signal, the completion of removal of lubricating composition from the crankcase oil pan.

One function of the conduit is to provide fluid communication between the vacuum chamber and the probe means. The conduit can be made of any material; e.g., metal such as iron, steel, stainless steel, copper, aluminum and the like; plastics; etc., which is compatible with the construction of the probe and the remainder of the apparatus and is suitable for handling lubricating compositions, often at elevated temperatures, e.g., about 100° F. to about 250° F., or more. The conduit may comprise more than one section and/or may be made from more than one material of construction. It is preferred that at least a portion of the conduit be pliable in order that the probe be easy to handle and manipulate.

The probe means which is in fluid communication with the first end of the conduit is, of course, itself hollow. The essential feature of the flexible means is that the terminal portion, i.e., termination, or first end of this means be capable of reaching the proximity of at least one point of the bottom inside surface of the crankcase oil pan when inserted into the oil dipstick well. This feature is particularly important when oil is to be removed from engines having certain configurations. For example, certain V-8 engines are designed so that the bottom of the oil pan can be reached via the oil dipstick well only after one or more severe bends. If the dipstick well probe is unable to make these severe bends, the first end of the probe means will not reach near the bottom of the oil pan and the entire oil removal operation will be incomplete, i.e., lubricating composition at the bottom of the crankcase oil pan will remain. Therefore, it is essential that the termination of the probe means be able to reach the proximity of at least one point of the bottom inside surface of the oil pan.

Although the probe means may be made of any sufficiently flexible material, it is preferred that this means be constructed out of substantially organic polymer, e.g., plastic. Examples of suitable flexible materials include olefin polymers, polyurethane, nylon, teflon and the like. Preferably, the flexible means is made from a material comprising a major amount of olefin polymer such as polyethylene, and especially polypropylene, and mixtures thereof, and more preferably from a material selected from the group consisting of nylon and teflon, since it has been found that these materials not only have the desired flexibility but also withstand service in lubricating oil at elevated temperatures well.

The size of the probe means is not critical. However, the probe means should be sized so that at least a portion can be inserted into the dipstick well and so that the termination of this probe means is capable of reaching the proximity of at least one point of the bottom inside surface of the oil pan. Thus, the size of the probe means will vary depending, for example, on the size of the dipstick well and the configuration of the particular internal combustion engine being worked on. Typically, for example, for engines associated with automobiles and the like transportation means, the hollow space formed by the probe means has a cross-sectional area in the range from about 0.0002 in.$^2$ to about 0.04 in.$^2$, preferably from about 0.0003 in.$^2$ to about 0.025 in.$^2$. The thickness of the walls of such probe means often range from about 0.01 inch. to about 0.10 inch., preferably from about 0.01 inch. to about 0.05 inch. The length of the probe means may vary, for example, from about 1 inch. or less to about 4 feet or more, preferably in the range from about 9 inches to about 3 feet.

In one preferred embodiment, the present apparatus further comprises a substantially rigid member or members associated with the probe means to inhibit, preferably substantially inhibit, the probe means from bending upon contact with the bottom inside surface of the oil pan. The substantially rigid member or members may be located at least partially inside and/or outside, preferably substantially outside, the hollow space formed by the wall of the probe means. The substantially rigid member or members may be mechanically interconnected to another component or components of the present apparatus. Preferably, these rigid members are at least partially embedded in the walls of the probe means. Thus, the probe means can be fabricated with the substantially rigid members at least partially embedded in the walls thereof. As an alternate, the flexible means can be heated so that when the substantially rigid members are brought into contact with the walls of the probe means the members become at least partially embedded therein. The size of the substantially rigid member is not critical. The substantially rigid members of the present apparatus may be constructed of any material which will allow it to perform its function, i.e., to inhibit the probe means from bending upon contact with the bottom inside surface of the oil pan. The term "bending" as used herein refers to any moving of the termination of the probe means away from the bottom inside surface of the oil pan. The materials of construction of the substantially rigid member should be capable of maintaining their substantial rigidity while being in contact with lubricating compositions at elevated temperatures, e.g., from about 100° F. to about 250° F. or more. Typical materials of construction for the substantially rigid member include metals such as iron, steel, copper, aluminum and the like.

Particularly preferred substantially rigid members comprise lengths of metal wire having substantially circular cross sections with diamters in the range from about 0.005 inch. to about 0.10 inch., more preferably from about 0.01 inch. to about 0.04 inch. In a preferred embodiment of the present invention, two substantially rigid members are at least partially embedded in substantially opposing walls of the flexible means and extend along a substantial portion, more preferably, a major portion of the length of the flexible means.

In another useful modification of the present invention, at least one of the substantially rigid members extends beyond the termination of the probe means by a distance in the range from about 0.01 inch. to about 1.0 inch., preferably from about 0.05 inch. to about 0.5 inch. In this embodiment, the extended substantially rigid member performs another useful function — it provides a positive indication, for example, by sound, feel and the like, that the probe means has reached the bottom inside surface area of the oil pan. This positive indication function may involve electrical and/or electronic means. Thus, the extended substantially rigid member may be electrically associated with a signaling device, and the like, which is set off upon the extended member making contact with the bottom inside surface of the oil pan. This positive indication function is especially useful in instances where the engine owner, e.g., automobile owner, desires to change the crankcase lubricant himself. In other words, the positive indication provided by the extended substantially rigid member substantially eliminates the guess work involved in properly inserting the probe into the dipstick well.

The vacuum chamber component of the present apparatus is attached to and in fluid communication with the conduit. During the time when lubricating composition is being removed from the crankcase oil pan, the vacuum chamber has sufficient vacuum so that the lubricating composition from the oil pan will pass through the conduit and into the chamber. Clearly, this vacuum chamber would be constructed so as to withstand the presence of such vacuum within. Preferably, such levels of vacuum range from about 10 in.Hg. to about 28 in.Hg., more preferably from about 20 in.Hg. to about 27 in.Hg., so that lubricating composition can be removed at a reasonably efficient rate. In one preferred embodiment, the present vacuum chamber is constructed of metal, such as iron, steel, aluminum and the like, having sufficient strength to withstand the required levels of vacuum. Such construction is particularly preferred when the present apparatus is portable since, for example, transparent plastic chambers tend to be less durable and more prone to impact damage (often caused when moving the oil changer from one location to another) than the presently preferred metal construction.

The shape of the present vacuum chamber is not critical to the present invention. Preferably, the vacuum chamber has sufficient volume to hold the entire amount of lubricating composition removed from the crankcase oil pan of at least one internal combustion engine. Thus, if the present apparatus is to be used to remove lubricating composition from engines associated with automobiles, preferably the vacuum chamber has a volume ranging from about 5 U.S. quarts to about 20 U.S. quarts, more preferably from about 5 U.S. quarts to about 15 U.S. quarts.

The present apparatus may also include an oil storage reservoir associated with the vacuum chamber. Such reservoir functions to provide short term storage for the lubricating composition removal from the oil pan to the vacuum chamber. Thus, after the oil removal is complete, the composition in the vacuum chamber can be past to the reservoir, e.g., using conventional valving means, for storage. Although the size and shape of this reservoir is not critical, preferably this reservoir has sufficient volume to hold from about 20 U.S. quarts to about 100 U.S. quarts of lubricating composition.

The present apparatus further includes a vacuum source in fluid communication with the vacuum chamber to provide the vacuum chamber with the desired level of vacuum. Any conventional source of vacuum may be employed in the present invention. For example, electric, mechanical or pneumatic driven vacuum pumps may be used. In one preferred embodiment, the vacuum source is a fluid driven aspirator, more particularly, an air driven aspirator. In this preferred embodiment, fluid, e.g., compressed air, is caused to flow through the aspirator. The movement of this fluid through the aspirator causes gas from the vacuum chamber to evacuate thus creating the desired level of vacuum in this chamber. An aspirator employing compressed air as the working fluid is preferred since a source of compressed air is often readily available at locations, e.g., automotive service stations, where the present apparatus is contemplated for use. Although the vacuum source may be used intermittently to provide the desired level of vacuum in the vacuum chamber, e.g. prior to commencing the removal of lubricating composition from the crankcase oil pan, preferably, the vacuum source operates to maintain substantially a constant degree of vacuum within the vacuum chamber substantially throughout the time during which lubricating oil is being removed from the oil pan.

The present signalling means acts in response to the amount of vapor flowing to the chamber to signal the completion of removal of lubricating composition from the crankcase oil pan. In a preferred embodiment, such means provides an audible signal of such completion. For example, a sound implement, e.g., whistle, can be placed in fluid communication with both the vacuum chamber and the vacuum source. As the removal of lubricating composition is completed, vapors from the crankcase oil pan will rush into the vacuum chamber and then into the line between this chamber and the vacuum source. This sudden movement of vapor will cause a sound to emanate from the sound implement thereby signalling the completion of the lubricating composition removal.

In a particularly preferred embodiment, the functions of the vacuum source and the signalling means are carried out by a gas, e.g., air, driven aspirator which is in fluid communication with the vacuum chamber, acts to supply the desired level of vacuum to the vacuum chamber and is constructed so that as the lubricating composition removal is completed, the flow of gas from the crankcase to the vacuum chamber and through the aspirator acts to emit a sound having a different pitch, therefore, signals the completion of the lubricating composition removal. Using such signalling means to positively and sensitively indicate the completion of lubricating composition removal from crankcase oil pans provides improved efficiency of removal along with reduced time of removal.

The present apparatus can be used to remove lubricating compositions from the crankcase of any internal combustion engine which is equipped with a crankcase lubricating composition reservoir, e.g., oil pan, oil sump and the like, and a crankcase dipstick well. Among the types of engines included may be 2 cycle engines 4 cycle engines, rotary piston driven engines, turbine engines and the like. Engines which are normally operated in association with transportation means such as automobiles, trucks and the like are especially well suited for the present invention, although lubricating compositions can be removed using the present dipstick well probe from engines operated in association with non-transportation means.

The lubricating compositions which can be removed using the present dipstick probe include those compositions, e.g., compounded mineral oil of desired viscosity, synthetic lubricants and the like, which are normally used to lubricate the crankcases and other associated components of internal combustion engines. Extraneous material such as engine fuel, carbonaceous decomposition products, metal and non-metal-containing particulate matter and the like, may be mixed with the lubricating compositions to be removed and may itself be removed through the present probe.

These and other aspects and advantages of the present invention are set forth in the following detailed description and claims, particularly when considered in conjunction with the accompanying drawings in which like parts bear like reference numerals.

Figure 1:
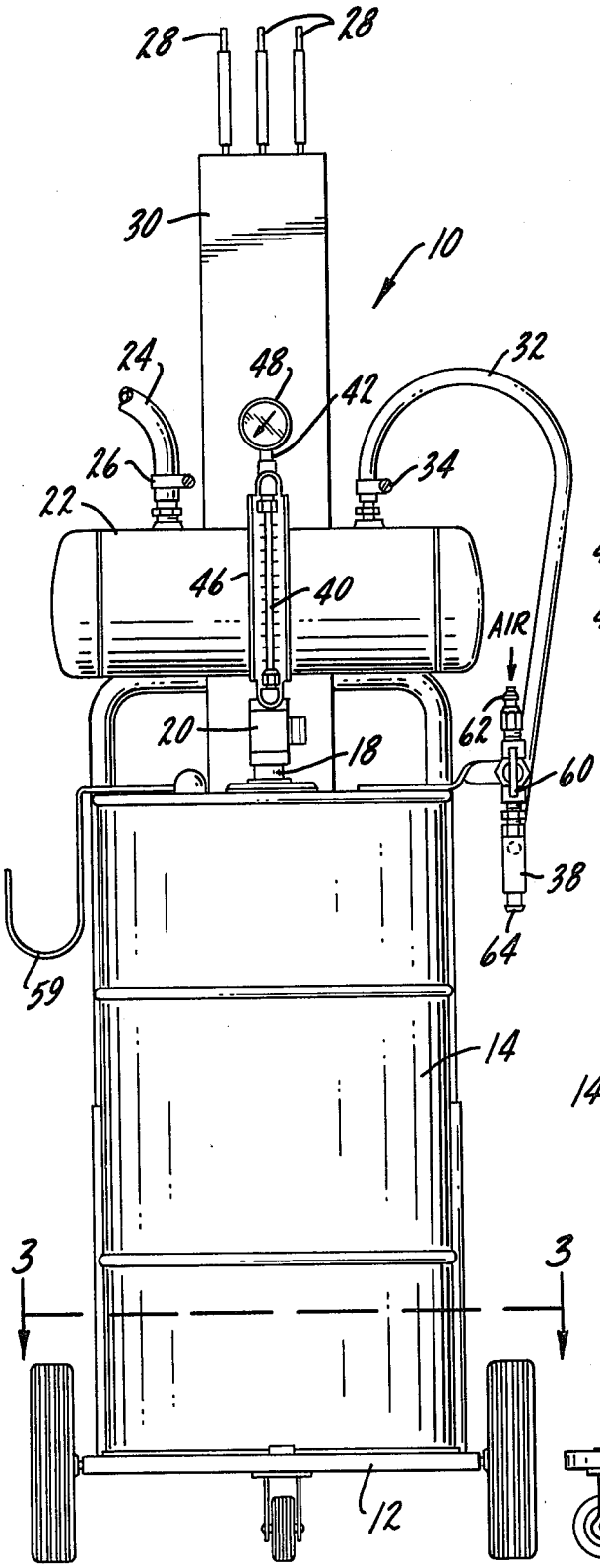
FIG. 1 is a front plant view of one embodiment of the present apparatus.

Referring now to the drawings, one embodiment of the present oil changer is shown as 10. Oil changer 10 is disposed on wheeled cart 12, which allows oil changer 10 to have the feature of portability. Oil drum 14 is set directly on wheeled cart 12. Oil drum 14 is used to temporarily store the used lubricating composition which is removed by oil changer 10 from the crankcases of internal combustion engines. Oil drum 14 is equipped with valved spout 16 which is periodically opened to allow the used lubricating composition in oil drum 14 to be drained.

Inlet line 18 and valve 20 provide periodic fluid communication between oil drum 14 and vacuum chamber 22. Vacuum chamber 22 is attached to probe conduit 24 using clamp 26. Probe conduit 24 provides fluid communication between vacuum chamber 22 and dipstick probe 28 (shown in FIGS. 1 and 2 as being stored and ready for use). Dipstick probe 28 can be quickly attached to probe conduit 24, for example, by means of a conventional "quick" connection or simply by inserting one end of the dipstick probe 28 into the probe conduit 24. In this latter embodiment the outside diameter of dipstick probe 28 and the inside diameter of probe conduit 24 are properly sized to provide a snug connection. In any event, the connection between probe conduit 24 and dipstick probe 28 is preferably easily and rapidly broken when desired so that the dipstick probes 28 can be stored in holder 30 when not in use.

Vacuum chamber 22 is further attached to suction line 32 using clamp 34. Suction line 32 is also attached to inlet line 33 of air aspirator 38 using clamp 36. Air flow through air aspirator 36 provides the desired degree of vacuum in suction line 32 and vacuum chamber 22. The operation of air aspirator 36 will be described in detail hereinafter.

Liquid level gauge 40 is in fluid communication with vacuum chamber 22 through pipes 42 and 44. Liquid level gauge 40 acts to visually show the level of liquid within vacuum chamber 22. Associated with liquid level gauge 40 is calibrated chart 46. Calibrated chart 46 is marked off in desired units of volume, e.g., quarters of quarts, so that the amount of liquid in vacuum chamber 22 can be determined in easily recognizable terms. Vacuum gauge 48 is in fluid communication with vacuum chamber 22 through an extension of pipe 42. Vacuum gauge 48 acts to visually display the degree of vacuum present in vacuum chamber 22.

Bolts 50 through holder 30 act to further secure the position of vacuum chamber 22. Bolts 50 also act to secure can opener 52 to holder 30. Can opener 52 is thus placed to allow rapid opening of a can or cans containing lubricating composition which replaces the used composition removed from the engine crankcase by oil changer 10. Racks 54 and 56 are welded to support 58 which is, in turn, securely fastened to oil drum 14. Racks 54 and 56 provide storage space for cans of replacement lubricating oil composition. Hook 59 is securely fastened to oil drum 14. Probe conduit 24 may be stored when not in use by winding probe conduit 24 around hook 59.

Figure 2:
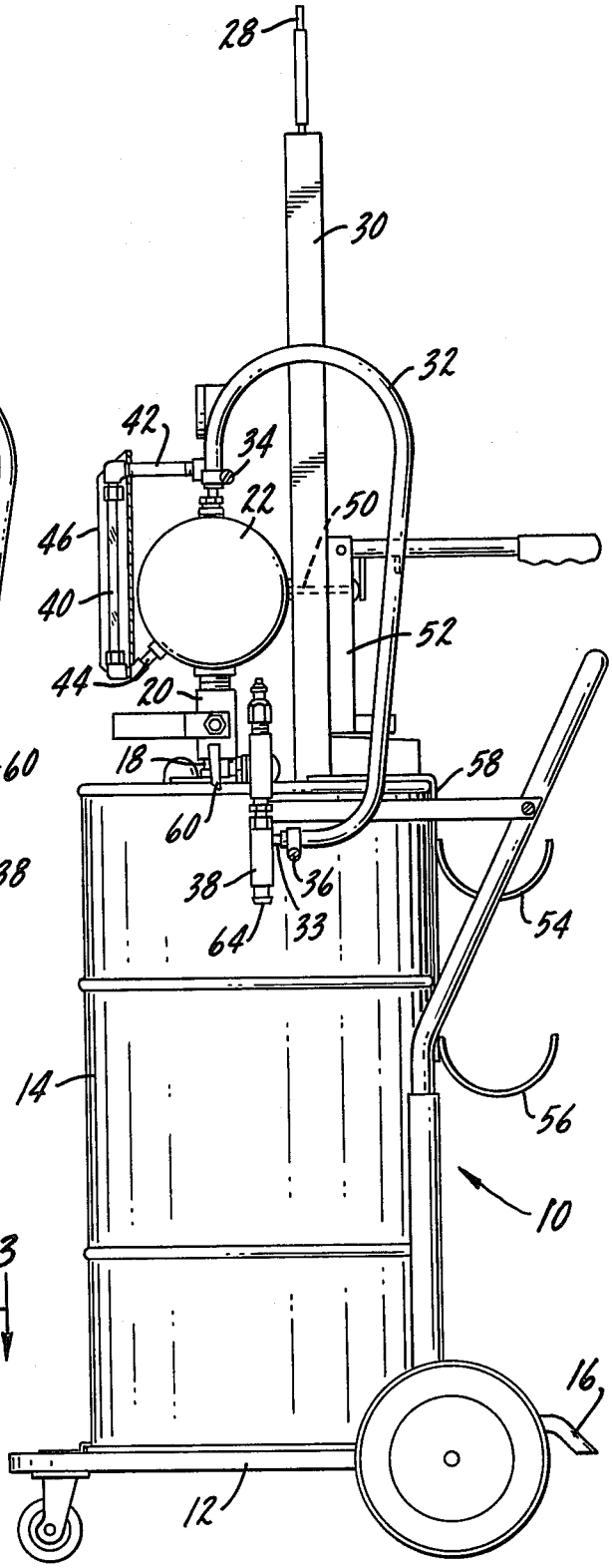
FIG. 2 is a side plan view of the embodiment shown in FIG. 1.
Figure 3:
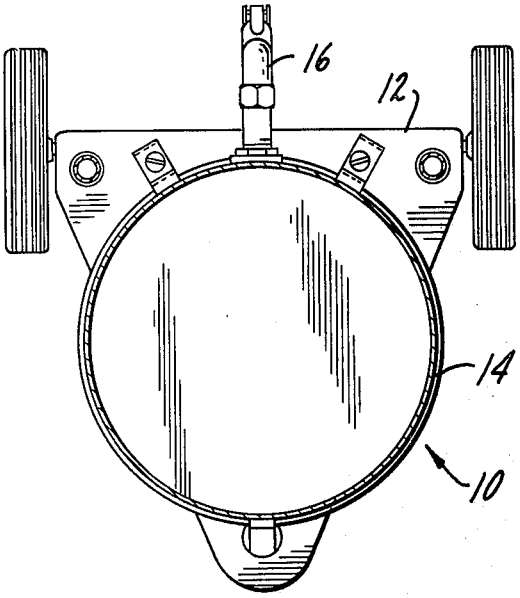
FIG. 3 is a section view taken along line 3—3 of FIG. 1.
Figure 4:
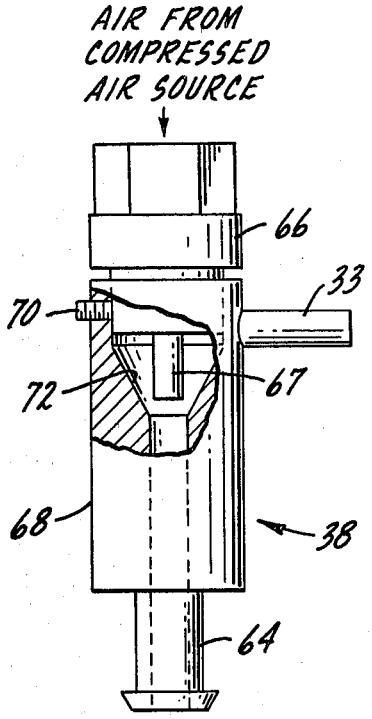
FIG. 4 is an enlarged view, partly in section, of the sound signalling portion of the apparatus shown in FIG. 1.

Air aspirator 38 functions as follows. Air, from a compressed air source (not shown), is caused to flow through air aspirator 38 as shown in FIGS. 1 and 4. The flow of air through air aspirator 38 can be controlled and even turned off, by adjusting the position of valve 60. The source of compressed air may be connected to the aspirator system using a conventional "quick connection", one portion of which is shown as male connector 62.

As air flows through air aspirator 38, vapors from vacuum chamber 22 are urged to evacuate vacuum chamber 22 through suction line 32 and inlet line 33. Thus, vapors from vacuum chamber 22 are combined with the air flowing through air aspirator 38 and exit air aspirator 38 through outlet 64. In this manner, the desired level of vacuum is achieved within vacuum chamber 22.

One especially preferred embodiment of the present invention is illustrated in FIG. 4. In this Figure, air aspirator is shown to be constructed of an upper portion 66, having plug 67, and a lower portion 68. The position of upper portion 66 relative to lower portion 68 is adjustable using two set screws 70, only one of which is shown. By adjusting the position of upper portion 66 and lower portion 68 so that the distance between plug 67 and conical surface 72 is slightly increased, the pitch of the sound of vapors flowing through air aspirator 36 has been found to be predictably dependent on the amount of such vapors. Thus, as long as liquid lubricating composition is being sucked into vacuum chamber 22 through probe conduit 24, little or no vapors exit from vacuum chamber 22. However, as soon as the removal of lubricating composition from the crankcase oil pan is complete, vapors are sucked into vacuum chamber 22 through probe conduit 24 and are urged to evacuate vacuum chamber 22 through suction line 32. Thus, additional vapors are caused to flow through air aspirator 38, resulting in a change in the pitch of the sound eminating from air aspirator 38. This change in sound pitch is a very sensitive indication that the removal of lubricating composition from the crankcase oil pan is complete.

While this invention has been described with respect to various specific examples and embodiments, it is to be understood that the invention is not limited thereto and that it can be variously practiced within the scope of the following claims.

The embodiments of the invention in which an exclusive property or privilege is claimed are defined as follows:

1. An apparatus for removing lubricating composition from the crankcase oil pan of an internal combustion engine through the lubricating composition dipstick well of said engine which comprises:

a hollow probe, having first and second ends, through which said lubricating composition passes from said oil pan, said first end of said probe being capable of reaching the proximity of the bottom inside surface of said oil pan through said dipstick well;

a conduit, having first and second ends, through which said lubricating composition passes from said probe means, said first end of said conduit being attached to said second end of said probe means so as to provide fluid communication between said probe means and said conduit;

a vacuum chamber being attached to and providing fluid communication with said second end of said conduit, said vacuum chamber being under sufficient vacuum so as to cause lubricating composition to pass from said conduit into said vacuum chamber and to be collected therein;

a vacuum source in fluid communication with said vacuum chamber capable of providing said vacuum chamber with the desired level of vacuum; and an adjustable signalling means for providing a distinctly audible pitch acting in response to the amount of vapor flowing to said vacuum chamber to signal when removal of said lubricating oil composition from said crankcase oil pan is complete.

2. The apparatus of claim 1 wherein said signalling means acts to audibly signal when removal of said lubricating oil composition from said crankcase oil pan is complete.

3. The apparatus of claim 2 wherein said vacuum source is a fluid driven aspirator.

4. The apparatus of claim 2 wherein said vacuum source is an aspirator driven by the flow of gaseous medium.

5. The apparatus of claim 4 wherein said gaseous medium is air.

6. The apparatus of claim 5 which further comprises a storage compartment located in relation to said vacuum chamber so that collected lubricating composition from said vacuum chamber is passed to and stored in said storage compartment.

7. An apparatus for removing lubricating composition from the crankcase oil pan of an internal combustion engine through the lubricating composition dipstick well of said engine which comprises:

a hollow probe, having first and second ends, through which said lubricating composition passes from said oil pan, said first end of said probe being capable of reaching the proximity of the bottom inside surface of said oil pan through said dipstick well;

a conduit, having first and second ends, through which said lubricating composition passes from said probe means, said first end of said conduit being attached to said second end of said probe means so as to provide fluid communication between said probe means and said conduit;

a vacuum chamber being attached to and providing fluid communication with said second end of said conduit, said vacuum chamber being under sufficient vacuum so as to cause lubricating composition to pass from said conduit into said vacuum chamber and to be collected therein; and an aspirator driven by the flow of gaseous medium in fluid communication with said vacuum chamber capable of providing said vacuum chamber with the desired level of vacuum, said aspirator having first and second portions, said first portion having an adjustable plug extending into said second portion, which are mutually positioned so that as said removal of lubricating composition is completed, the flow of gas from said crankcase to said vacuum chamber and through said aspirator acts to emit a sound having a different pitch, thereby audibly signalling when removal of said lubricating oil composition from said crankcase oil pan is complete.

8. The apparatus of claim 7 wherein said gaseous medium is air.

9. The apparatus of claim 8 which further comprises a storage compartment located in relation to said vacuum chamber so that collected lubricating composition from said vacuum chamber is passed to and stored in said storage compartment.

* * * * *